United States Patent [19]

Borstelmann

[11] 4,146,065

[45] Mar. 27, 1979

[54] METHOD AND MACHINE FOR CHARGING LIQUID INTO CONTAINERS

[75] Inventor: Wolfgang Borstelmann, Dortmund, Fed. Rep. of Germany

[73] Assignee: Holstein & Kappert GmbH, Dortmund, Fed. Rep. of Germany

[21] Appl. No.: 913,867

[22] Filed: Jun. 8, 1978

[30] Foreign Application Priority Data

Jun. 18, 1977 [DE] Fed. Rep. of Germany ..... 2727446

[51] Int. Cl.[2] ..... B65B 3/04

[52] U.S. Cl. ..... 141/5; 141/39

[58] Field of Search ..... 141/1, 4–8, 141/37, 39, 54, 46, 192, 197, 198, 286, 40, 49, 52, 53, 302, 57, 58, 63, 64, 227, 303, 144–153, 95, 128

[56] References Cited

U.S. PATENT DOCUMENTS 3,799,219 3/1974 Uth et al. ..... 141/39

*Primary Examiner*—Houston S. Bell, Jr.
*Attorney, Agent, or Firm*—Michael J. Striker

[57] ABSTRACT

A method of charging into containers a liquid contained in a rotary tank of a bottling machine whereby different pressures are built up in each container during the filling process so that at the beginning the liquid is discharged by the force of gravity and thereafter the pressure in the container is reduced with respect to the tank pressure to introduce a quick filling phase; after attaining a predetermined amount of charge in the container or after a certain time interval the pressure in the container is automatically increased irrespective of the rotational is automatically increased irrespective of the rotational speed of the bottling machine or of the rate of flow of the discharged liquid. The bottling machine includes an annular channel the gas pressure of which is reduced with respect to the gas pressure in the tank but is higher than the atmospheric pressure. The channel communicates with the container to be filled by means of a control valve and a changeover conduit and in addition it is provided with an external pressure regulating device that adjusts the pressure in the channel independently from the operational condition of the machine.

9 Claims, 3 Drawing Figures

METHOD AND MACHINE FOR CHARGING LIQUID INTO CONTAINERS

BACKGROUND OF THE INVENTION

This invention is concerned with a method of and a device for charging liquid into containers such as bottles and the like. In particular, this invention relates to a rotary bottling machine in which different pressures are built up during the filling process in the container to be filled so that during starting the pressure between the container and the storage tank is equalized and the liquid is discharged under the influence of gravity and thereafter the pressure in the container is reduced so that a quick filling phase is initiated.

In German Patent No. DP-GBM 1,968,011 a filling system is described which includes a valve arranged in the gas return conduit opening into the gas pressure space of a rotary liquid tank and permitting a connection of the gas return conduit with the outer atmosphere. The control of this valve is effected by means of stationary stops or cam surfaces arranged in the path of movement of the tank and abutting against projecting push rods of the valve. The system has further a filling unit including a filling valve in the form of an elongated pipe and upon applying the filling unit against the container to be filled the pressure between the container and the tank is equalized. As soon as the equal pressure in the container is built up, the filling valve opens and the liquid flows into the bottles by the action of gravity. In addition, there is provided a device that makes it possible to create a pressure difference resulting in an increased speed of the liquid during its discharge to the bottle. In the normal course of filling operation the valve arranged in the gas return channel communicating with the liquid tank is opened and connects the gas return conduit to the outer atmosphere. Consequently a considerable pressure difference is created that effects a faster discharge of the liquid. The valve itself is controlled by means of outside control cams arranged at the circular track of the filling machine. If the filling machine for one reason or another decelerates its rotary motion or if it stops and starts again, there is no possibility to control this valve so that the quick filling action continues until the whole filling process is terminated. This shortcoming, however, can make considerable operational difficulties since during the slowdown of the movement of the filling machine a considerable part of the liquid is discharged into widely branched channels in the filling unit and the spilled liquid can prevent an exact definition of the level of filling that is essential in the filling operation. This failure occurs not only during a momentary interruption of the rotary movement of the filling machine but also during its coasting or restarting. In the endeavor to diminish this disturbance, the stationary control cams for each atmosphere valve has been made tiltable. In modern bottling machines having large diameters and circumferential speeds this tiltable arrangement is no longer applicable because due to correspondingly increased power the inertia effects of the system would prevent an exact control. For example, the auxiliary mechanical control of the cams is completely out of the question in filling machines controlled according to their output so that all cooperating devices are correlated according to the rate of the liquid discharge. Another disadvantage of the known devices resides in the fact that due to the relatively narrow channels, the liquid particles produce undefinable throttling or choking effects so that pressure differences vary and these pressure variations may cause again inaccurate filling of the bottles. These undesired effects may take place even in an arrangement where, in order to define the pressure difference, chokes or restrictions are provided in the return gas or return air conduits because bubbles especially in the case of $CO_2$ containing liquids, and/or liquid remainders change the prearranged choking gap.

SUMMARY OF THE INVENTION

It is therefore a general object of this invention to overcome the aforementioned disadvantages.

More particularly, it is an object of the invention to provide an improved filling system for the filling machines of the above-described type.

An additional object of the invention is to provide a filling system that enables a time control of the quick filling phase of the filling operation independently from pressure conditions in the system.

A further object of the invention is to provide controlling means for insuring an accurate filling of the containers within a predetermined time interval.

An additional object of the invention is to provide such an improved filling control device that avoids the disturbances that hitherto have resulted during the coasting and restarting of the bottling machine.

A still further object of the invention is to provide a filling control device that prevents changed operational conditions of the machine resulting from the interruption of its operation from influencing the preselected time interval for filling, and avoids the extension of the quick filling phase over a predetermined volume of the discharged liquid.

A still additional object of the invention is to provide such an improved filling system that can dispense with the external controlling surfaces or cams.

In keeping with these objects, and others which will become apparent hereafter, one feature of the invention resides, in a method for charging bottles with a liquid in a rotary bottling machine of the above-described type in that the pressure in the container to be filled after the starting of the filling process, is reduced for a predetermined time interval or for a predetermined discharged volume and after the expiration of this time interval or after attaining the prescribed charge level and before the completion of the filling process, the pressure inside the container is automatically increased to the prevailing pressure in the system irrespective of the momentary rotational speed or rate of flow in the bottling machine. In the preferred method of this invention, as soon as a predetermined filling level in the bottle is attained, the pressure in the annular channel with the control valve in open position is increased to the pressure of the pressure tank.

In a modification, the pressure inside the annular channel at an open control valve is increased within an adjustable time interval to the value of the pressure inside the liquid tank as soon as the filling machine exceeds a predetermined rate of flow.

In a further modification of the method of this invention, the speed of discharge within a predetermined time interval is increased and prior to the completion of the filling process the pressure in the annular channel is increased to a value in which liquid is discharged by the force of gravity only and the charging speed of the containers is reduced.

The bottling machine for carrying out the method of this invention has an annular tank provided with filling devices each including a filling pipe for the liquid and a return gas conduit as well as a control space with the pressure relief conduit; the tank is surrounded in a conventional manner by an annular channel the inner pressure of which is inferior to the pressure in the liquid tank but higher than the atmospheric pressure; the control space communicates with the inner space of the container to be filled and is connected via a valve controlled branch conduit to the annular channel whereby the annular channel is equipped with an externally controlled pressure regulating device.

In a preferred embodiment of this pressure regulating or controlling device according to this invention, in the section of the circular track of the rotary bottling machine are arranged controlling elements for detecting the height of the charge in the container and upon attaining the predetermined height or level of the charge in the container the control devices generate a control impulse that is applied to the pressure regulating device connected to the annular channel and actuates this device to increase the pressure in the channel.

In a variation, the pressure regulating device that is assigned to the annular channel is controlled in response to the rotational speed of the annular liquid tank. In another modification of this invention the control impulse from the charge level controlling devices is transmitted by means of approximation means cooperating with the switching element of the pressure regulating device. Finally, it is also within the scope of this invention to design the annular channel as a pressure chamber divided into a plurality of partitions each having a reduced pressure and being provided with a separate pressure regulating device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
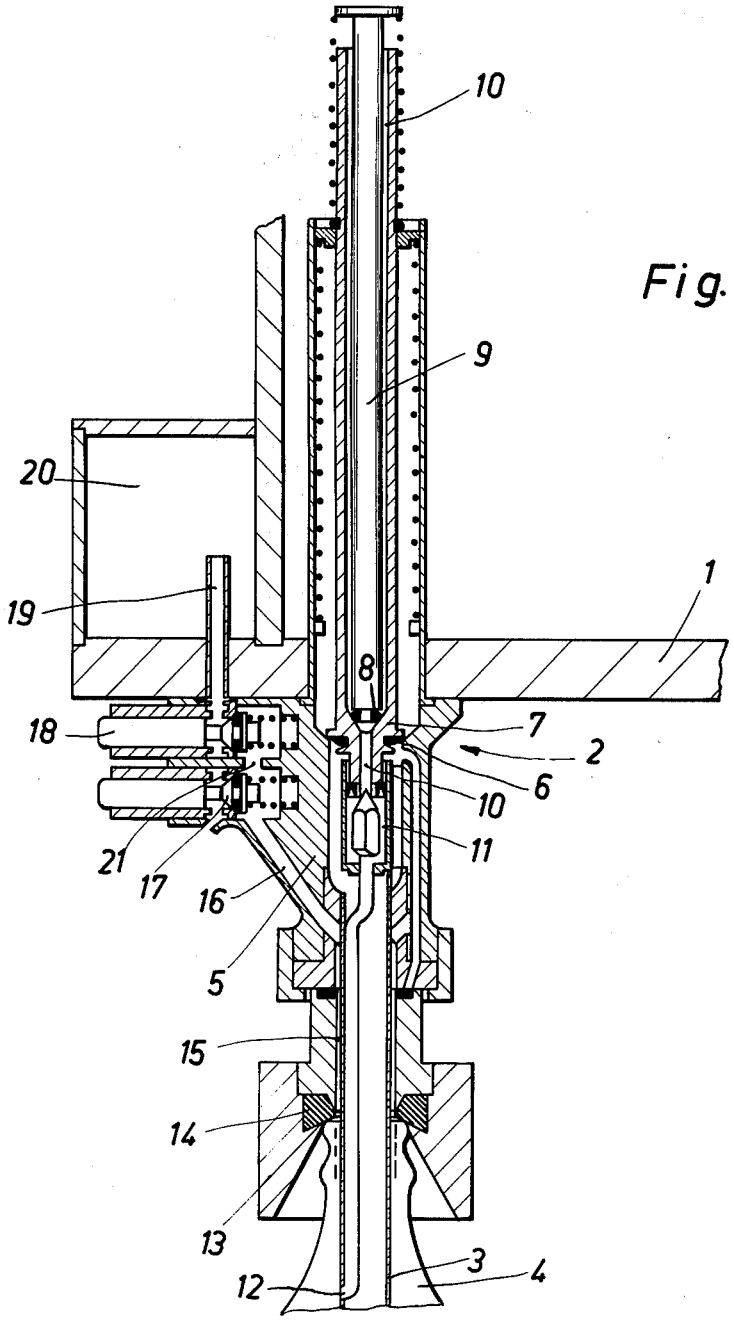
FIG. 1 is a sectional side view of a filling machine.
Figure 3:
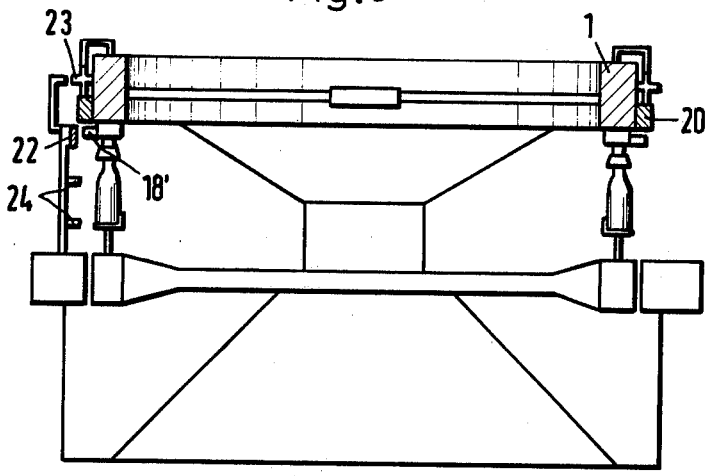
FIG. 3 is a side view, partly in section of a part of the machine of FIG. 2.
Figure 2:
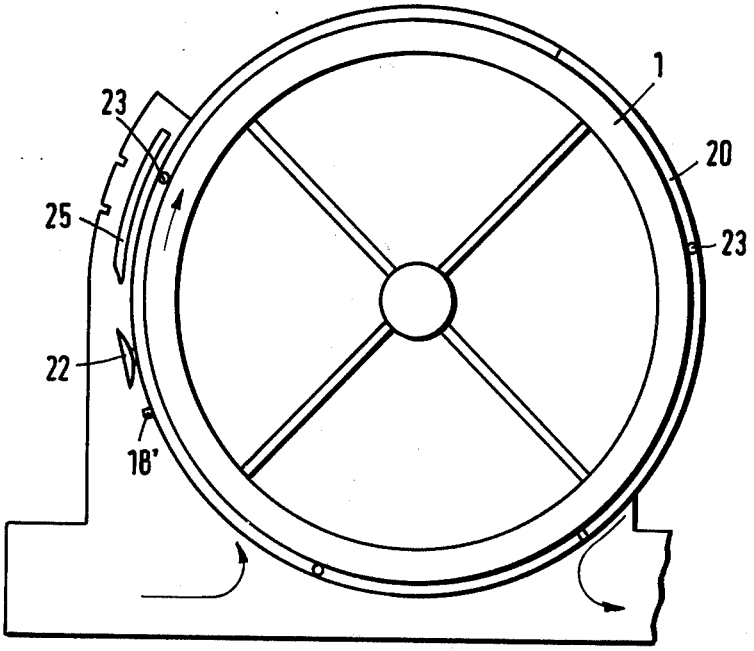
FIG. 2 is a top view of the filling machine.

Referring firstly to FIG. 1, the filling machine comprises a rotary annular liquid tank 1 provided with a filling system 2 that includes a filling pipe 3 projecting downwardly from the bottom of the tank 1 into the interior of a bottle or container 4 to be filled with a liquid from the tank 1. The filling pipe 3 is firmly connected to a filling head 5 in which a valve seat 6 is formed to support a tubular valve body 7 projecting into the interior of the liquid tank 1. The valve body together with its closing portion is movable in axial direction to open and to close the fluid discharging pipe 3. Inside the tubular valve body 7, another valve 8 is provided to cooperate with a valve disc at the end of a rod 9 arranged in and projecting from the tubular valve body 7. The annular space between the interior of the valve body 7 and the rod 9 acts as pressure gas conduit between the interior of the tank 1 and the container or bottle to be filled. This pressure gas conduit 10 opens into a float chamber 11 and therefrom it extends downwardly into the filling pipe 3 and opens through port 12 into the interior of the container or bottle 4. The position of the port 12 in the bottle determines the level to which the bottle is charged with the liquid. An outer surface portion of the pipe 3 supports and guides a centering attachment 13 provided with seals 14 which a but against the rim of the bottle neck and seal an annular control space 15 provided in the filling head 5 and attachment 13, from the outer atmosphere. This sealed-off control space 15 communicates with a gas relief passage 16. In addition, the passage 16 is further connected through a changeover passage 21 with an additional or control valve 18 which opens through upwardly directed conduit 19 into an annular channel 20 arranged around the tank 1.

The gas pressure inside the annular channel 20 is lower than that in the tank 1 but higher than the atmospheric pressure. The actual pressure conditions are adjusted according to the type of liquid in the tank 1.

The filling process is started by opening the gas valve 8. This opening is carried out automatically by means of a control pinion (not shown) that is arranged at the annular channel 20 and during rotation of the machine engages with a stationary control mechanism that is adapted for lifting the rod 9. By this action the pressure difference between the interior of bottle 4 and the interior of tank 1 is equalized and as a result the spring-biased tubular valve body moves upwardly so that liquid from tank 1 flows by gravity into the bottle 4. As soon as a certain preliminary amount of liquid is discharged into the bottle 4 the projecting piston or control pin of the additional control valve 18 is depressed to open the connection between the interior of the bottle 4 and the interior of the annular channel 20 containing gas having reduced pressure. In this manner, a pressure difference is created between the interior of the bottle 4 and tank 1 and the reduced pressure in the bottle accelerates the discharge of the liquid. This quick filling phase, however, especially in the case of liquids containing $CO_2$ cannot last until the end of the filling process since due to increased speed of discharge the gas contained in the liquid is set free and would impair the accuracy of filling. Moreover, a portion of the liquid would reach the conduits in the control head 5 and upon the pressure relief in the control space 15 the spilled liquid would influence in an unpredictable manner the filling level in the bottle and the aforementioned advantages resulting from the additional use of a pressure space having a constant pressure would be nullified.

For this reason it is necessary that the quick filling phase be carried out within a predetermined time interval that is independent from the rotational speeds of the machine. If the control cam or surface is arranged at the circular track of the rotary filling machine to engage for a moment the control pin valve 18, a well-definable time interval can be achieved only then when a uniform rate of discharge of the liquid or a constant rotary speed of the machine is maintained. In practice, this condition can hardly be fulfilled because due to continuously changing operational conditions of associated operational devices, there always result different rates of discharge from the filling machine.

Under normal operating conditions the termination of the quick filling phase is initiated as soon as cam 22 starts disengaging from the control pin 18' of the control valve 18 so that the latter can close. The closing of the valve 18 can be also made in such a manner that in emergency situations, for example, the cam 22 is brought out of the reach of the control pin 18'. This arrangement, however, is advantageous only then when an abrupt disconnection of the filling process or stopping of the machine is desired. Under normal operational conditions the pressure in the container to be charged is at the beginning of the filling process, equalized with the pressure in the liquid tank and thereafter it is reduced for a predetermined time interval or for a predetermined charge value and before the completion of the filling process the pressure in the container is again increased to the pressure prevailing in the system by means of a separate pressure regulating device operating independently of the rotational speed or of the rate of flow of the bottling machine. This pressure increase, namely the increase of the pressure in the annular channel with control valve open to the pressure of the liquid tank, is preferably introduced when a predetermined charge level in the container has been attained. For this purpose the annular channel 20 is provided with a pressure regulating device 23 controlled from the outside by means of filling height or level monitoring sensors 24 arranged at the section of the circular track of the rotary machine that corresponds to the quick filling phase. As soon as the liquid in the bottle has attained a predetermined level the controlling members 24 generate a control impulse that is applied to the pressure controlling device 23 operatively connected to the annular channel 20 and the control device 23 increases the gas pressure in the channel for example by opening the communication between the channel 20 and the tank 1. This actuation of the control device 23 can be also effected in response to the rotational speed of the bottling machine and can be made by any suitable known devices such as a tachogenerator. In this way the pressure in the annular channel 20 at open valve 18 is built up during a preselectable time interval or after a predetermined rate of flow in the machine has been exceeded. An advantageous separate control of individual segments of the annular channel can be effected by dividing the channel 20 into a plurality of separate chambers and providing each chamber with a pressure regulating device 23 controlled by sensors 24 to connect the channel 20 to the interior of the liquid tank 1. The control impulses are transmitted to the pressure regulating device 23 by means of proximity members 25 that during the rotation of the machine engage the actuation member of the pressure control device.

It will be understood that each of the elements described above, or two or more together, may also find a useful application in other types of constructions differing from the types described above.

When passing along the proximity member 25, the actuation member of the pressure regulating device 23 produces an impulse which is sufficient to actuate the actuation member.

While the invention has been illustrated and described as embodied in a rotary bottling machine, it is not intended to be limited to the details shown, since various modifications and structural changes may be made without departing in any way from the spirit of the present invention.

What is claimed as new and desired to be protected by Letters Patent is set forth in the appended claims.

1. A method of charging a liquid into containers by means of a rotary bottling machine having a liquid tank under an increased pressure, an annular channel under a reduced pressure and means for selectively applying the increased pressure, the intermediate pressure and atmospheric pressure into the containers to be filled, comprising the steps of equalizing the pressure between the container to be filled and the increased pressure in the tank to allow a slow discharge of the liquid under the influence of gravity for a short initial time interval; then reducing the pressure in the container for a predetermined time period defining a quick filling phase; and thereafter, before the completion of the filling process, increasing the pressure in the container independently of the rotational speed of the machine and of the rate of flow of the discharged liquid.

2. A method as defined in claim 1, wherein upon attaining a predetermined level of the liquid in said container, said intermediate pressure in said annular channel is increased up to the level of the pressure in said tank while said annular channel communicates with the interior of said container.

3. A method as defined in claim 1, wherein during a preselectable time interval the pressure inside said annular channel having an open control valve communicating with the interior of said container is, upon exceeding a predetermined rate of flow of the filling machine, increased to the value of the pressure in said tank.

4. A method as defined in claim 1, wherein during a predetermined time interval the discharging speed of said liquid from said liquid tank is increased and thereafter, before the completion of the filling process, the pressure inside the annular channel is increased to a value resulting in a discharging speed corresponding to that attained by gravity.

5. A filling machine having a rotary liquid tank, filling devices operatively coupled to the filling tank and including a liquid discharging pipe, a return gas conduit and a pressure relief conduit connecting through a control valve the inner space of the container with the outer atmosphere, comprising an annular channel surrounding the tank and adapted to be maintained at an intermediate pressure that is lower than the pressure in the liquid tank and higher than the pressure of the outer atmosphere; a pressure changeover conduit including said control valve and connecting said pressure relief conduit with said annular channel; and a pressure regulating device operatively coupled to the annular channel and operable to increase the pressure in said channel in response to a filling condition in said container.

6. A filling machine according to claim 5, including a circular track; and wherein said pressure regulating device includes sensors arranged in a section of the circular track of the machine corresponding to the quick filling phase of the filling process, said sensors being adjusted for detecting a predetermined level of charge in said container and to generate an output impulse for actuating said pressure control device to increase pressure in said annular channel.

7. A filling machine as defined in claim 5, further including means for generating a control signal in response to the rotational speed of the tank, said control signal being applied to said pressure control device to increase pressure in said annular channel.

8. A filling machine as defined in claim 5, wherein said pressure control device includes an actuating member cooperating with proximity means adapted for transmitting the control pulse to said actuating member.

9. A filling machine as defined in claim 5, wherein said annular channel is divided into a plurality of partial pressure chambers, each pressure chamber being provided with a separate pressure controlling device.

* * * * *